United States Patent [19]

Bennett

[11] 4,226,071

[45] Oct. 7, 1980

[54] METHOD FOR THE PREPARATION OF LOW TEMPERATURE STRUCTURE

[75] Inventor: Robert B. Bennett, Hebron, Ohio

[73] Assignee: The Dow Chemical Company, Midland, Mich.

[21] Appl. No.: 59,411

[22] Filed: Jul. 20, 1979

Related U.S. Application Data

[62] Division of Ser. No. 906,181, May 15, 1979.

[51] Int. Cl.[2] ..... E04B 1/00

[52] U.S. Cl. ..... 52/741; 52/409; 52/264

[58] Field of Search ..... 52/741, 264, 409, 404

[56] References Cited

U.S. PATENT DOCUMENTS

| | | | |
|---|---|---|---|
| 1,967,611 | 7/1934 | Finck | 220/430 |
| 3,047,701 | 7/1962 | Frungel | 52/173 |
| 3,138,132 | 6/1964 | Niemann | 52/407 |
| 3,259,264 | 7/1966 | Best | 220/415 |
| 3,906,693 | 9/1975 | Todorovic | 52/404 |

FOREIGN PATENT DOCUMENTS

| | | | |
|---|---|---|---|
| 2427056 | 12/1975 | Fed. Rep. of Germany | 52/408 |
| 28473 | 11/1956 | Finland | 52/408 |

OTHER PUBLICATIONS

French Published Application 2,029,836, 10-1970, to S.E.T. I.

*Primary Examiner*—John E. Murtagh
*Attorney, Agent, or Firm*—R. B. Ingraham

[57] ABSTRACT

Masonry buildings for low temperature applications such as freezers and the like are insulated by applying the insulation on the exterior and providing an external vapor barrier.

1 Claim, 6 Drawing Figures

METHOD FOR THE PREPARATION OF LOW TEMPERATURE STRUCTURE

This is a division of application Ser. No. 906,181, filed May 15, 1978.

Masonry buildings are frequently used for low temperature applications such as freezers, cold storage, and the like. Such structures are usually prepared by providing a vapor barrier on the inside of the masonry structure, for example, an asphalt coating may be applied to the walls, and floor to provide the desired vapor barrier and thermal insulation is applied over the vapor barrier in an amount sufficient to provide the desired insulating value for the intended use of the structure. The foam insulation is then covered with a facing material appropriate for the intended application of the building. A concrete floor can be poured over the foam insulation in the floor of the masonry structure and appropriate facing material such as a latex-modified cement mortar, cement asbestos board or other paneling applied to the inner surface. To provide effective insulation, the barrier layer must be continuous to prevent the build-up of ice within the building. Oftentimes, when such insulated structures are being prepared, the insulating contractor frequently has difficulty assuring the integrity of the moisture barrier as it may be damaged by workmen installing refrigeration equipment, electrical services, and the like, who do not appreciate the importance of maintaining the integrity of the vapor barrier. Once such a vapor barrier has been damaged and insulation installed thereover, repair is extremely difficult, in that a localization of the leak in the vapor barrier is difficult. Facing panels and insulating materials must be removed in order to gain access to the leaking vapor barrier.

It would be desirable if there were available an improved insulated masonry structure.

It would also be desirable if there were available an improved masonry structure which is quickly and easily constructed.

It would also be desirable if there were available an improved insulated structure in which there was ready access to the vapor barrier.

These benefits and other advantages in accordance with the present invention are achieved in a masonry building suitable for low temperature applications and having walls, floor, ceiling, a thermally insulating layer, a vapor barrier adjacent the thermally insulating layer thereby providing a building having at least masonry walls and a masonry floor, the improvement which comprises the insulating material being disposed externally to the wall, floor and ceiling, the vapor barrier being disposed external to the thermally insulating material.

Also contemplated within the scope of the present invention is a method for the preparation of a thermally insulated masonry building, the steps of the method comprising providing a building foundation including a masonry slab, disposing on said slab a vapor barrier, positioning on the vapor barrier a layer of thermally insulating material, constructing masonry walls on the layer of insulating material disposed on the slab, providing a floor member over the insulating material disposed on the slab, providing a roof which covers space enclosed by the walls, disposing on the roof and walls a layer of thermally insulating material, disposing a vapor barrier over the insulating material on the walls and roof and joining the vapor barrier of the walls to the vapor barrier disposed on the slab of the building.

Further features and advantages of the present invention will become more apparent from the following specification taken in connection with the drawing wherein.

Figure 1:
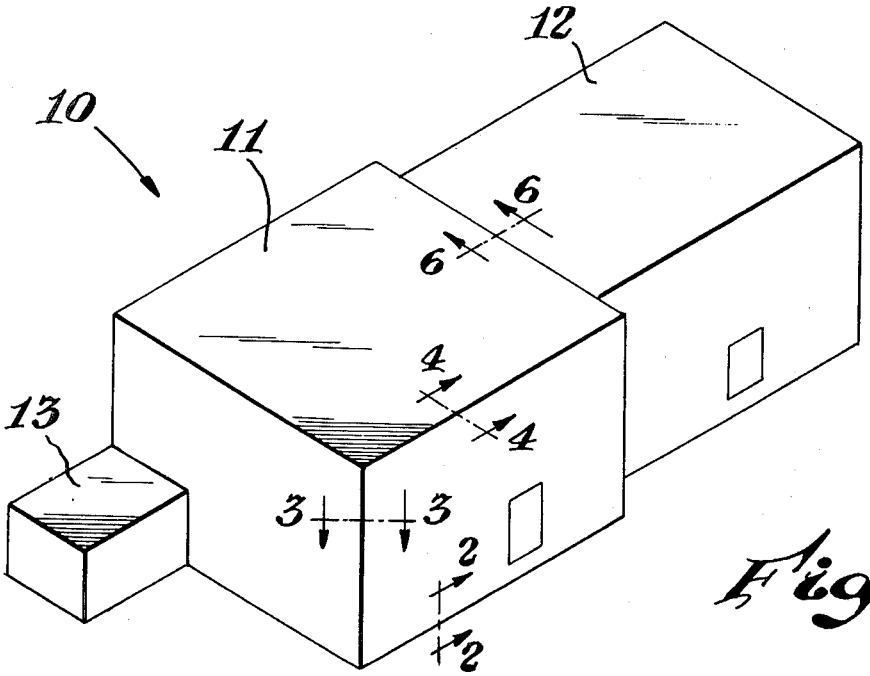
FIG. 1 is a schematic representation of a building in accordance with the present invention.

In FIG. 1 there is schematically depicted an isometric view of a building in accordance with the present invention generally designated by the reference numeral 10. The building 10 comprises a first portion 11 being a portion of maximum thermal insulation and the second portion 12 of lesser thermal insulation. A refrigeration unit 13 is attached to the exterior of portion 11 and provides the necessary cooling for the portions 11 and 12. Beneficially, a portion of greater insulation 11 may be a freezer, whereas the portion of lesser insulation 12 may be utilized as a cooler.

Figure 2:
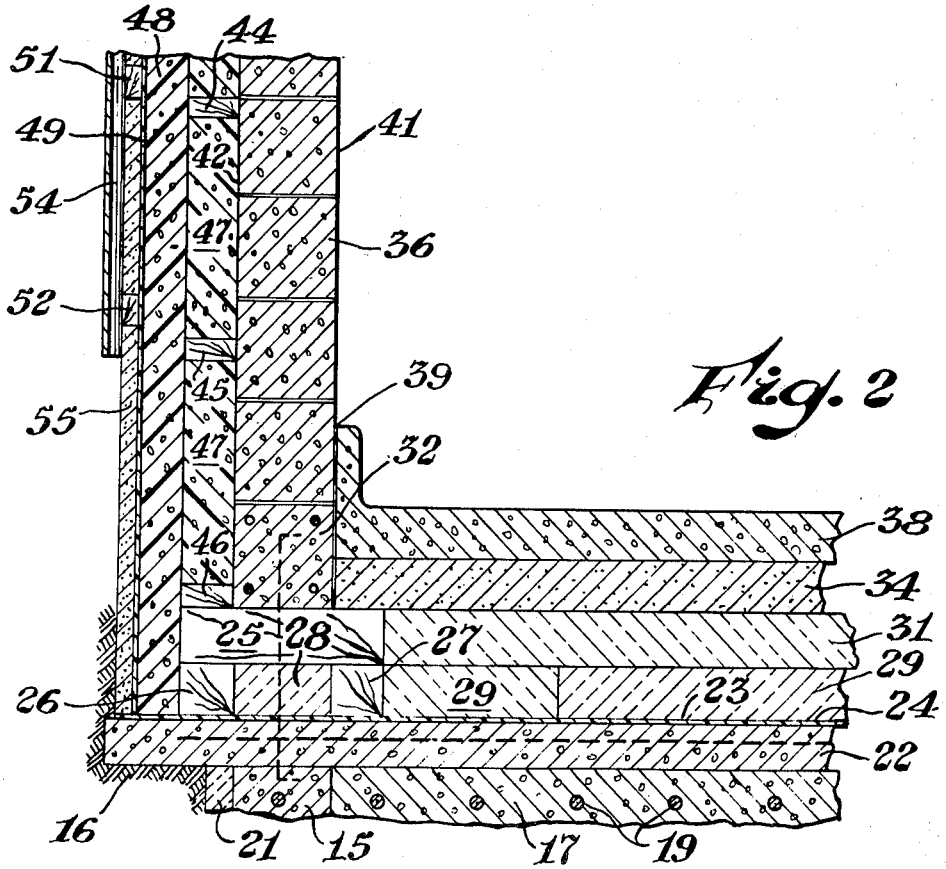
FIG. 2 is a sectional view of the building of FIG. 1 taken along the line 2—2 thereof.

In FIG. 2, there is schematically depicted a sectional view of the building 10 taken along the line 2—2 of FIG. 1. In FIG. 2 there is depicted a footing 15 set within ground 16. The footing 15 extends generally peripherally about the building 10. Enclosed within the footing 15 is a first particulate fill layer 17 beneficially of sand. Disposed within the layer 17 are a plurality of heating elements 19. The heating elements 19 are elongate cables which extend almost the entire length or width of the building depending in which direction they are laid and are a means to maintain the fill layer 17 at a temperature above the freezing point of water in the event that sufficient moisture is at least occasionally present to cause frost heaving. A layer of thermal insulation 21 extends peripherally about the footing 15. The insulating layer 21 is generally vertically disposed. A masonry slab 22 is disposed over the footing 15 and the layer 17. The slab 22 projects somewhat beyond the layer of insulation 21. The slab 22 has an upper surface 23 having disposed thereon a vapor barrier 24. Beneficially, the vapor barrier may be a layer of asphalt or a synthetic resinous film such as polyethylene, polyvinylchloride or cured-in-place polyurethane, and the like. The vapor barrier generally covers the entire surface 23 of the slab 22. Disposed on the vapor barrier 24 about the periphery of the building 10 is a cribwork 25. The cribwork 25, as depicted in FIG. 2, comprises members of low thermal conductivity 26 and 27 in generally parallel spaced-apart relationship which extend generally parallel to the footing 15 and a plurality of members of low thermal conductivity 28 which extend between members 26 and 27 and are remotely disposed from the vapor barrier 24. Beneficially, the cribwork 25 is of wood, high density or plastic foam (5–40 pounds per cubic foot). Spaces between members 26 and 27 are filled with an insulating material 28 such as a closed-cell plastic foam, glass-fiber bats and the like. Space enclosed by the cribwork 25 is filled with a plurality of thermally insulating members 29 disposed adjacent to the vapor barrier 24 and a plurality of insulating members 31 disposed over the insulating members or slabs 29. Above the cribwork 25 and remote from the vapor barrier 24 is disposed a grade beam 32, beneficially of reinforced concrete. The grade beam 32 extends generally entirely about the periphery of the building 10. Enclosed within the grade beam 32 and disposed over the insulated layer 31 is a second particulate layer 34, beneficially of sand. A masonry wall 36 is disposed over the grade beam 32 and as depicted in FIG. 2 is of concrete block. A masonry floor 38, beneficially of reinforced concrete, is disposed over the layer 34 and extends the entire length and width of the building 10. A caulking 39 is disposed about the periphery of the floor 38 and effectively seals the floor 38 to the wall 36. The wall 36 has an internal surface 41 and an external surface 42. A plurality of horizontally-extending wood ledgers indicated by the reference numerals 44 and 45 are affixed to the external surface 42 of the wall 36. A ledger 46, parallel to the ledgers 44 and 45, is affixed to the cribwork 25 adjacent the grade beam 32. Between the ledgers 44, 45 and 46 is disposed a first wall insulating layer 47. Beneficially, the layer 47 is a closed-cell insulating material such as styrene polymer foam. A second wall insulating layer 48 covers the layer 47 and ledgers 44, 45 and 46. The insulating layer 48 may be of similar or dissimilar material to the insulating layer 47. A vapor barrier 49 covers the insulating layer 48. The vapor barrier 49 is remote from the wall 36 and is external to the insulating layers 47 and 48. Advantageously, the barrier layer 49 may be integrally formed with the layer 48 as the layer 48 is applied in the form of panels. Adjacent panels may be sealed together with a material such as a butyl rubber tape to form an integral moisture vapor barrier. Alternatively, the vapor barrier 49 may be of material similar to that applied for the vapor barrier 24. A plurality of horizontal nailers such as nailers 51 and 52 are disposed external to the moisture vapor barrier 49 and are affixed to vertically-extending ledgers (not shown). Beneficially, when applying the nailers such as nailers 51 and 52, a sealant is applied on the surface of the nailer where the fastener will penetrate the vapor barrier 49 in order to maintain the integrity of the barrier. A metal siding 54 is affixed to the nailers 51 and 52 remote from the vapor barrier 49. A cement asbestos board 55 is disposed over the vapor barrier adjacent ground level so that the metal siding terminates above ground level and is not subjected to the corrosive and abrasive effects of the soil and rain.

Figure 3:
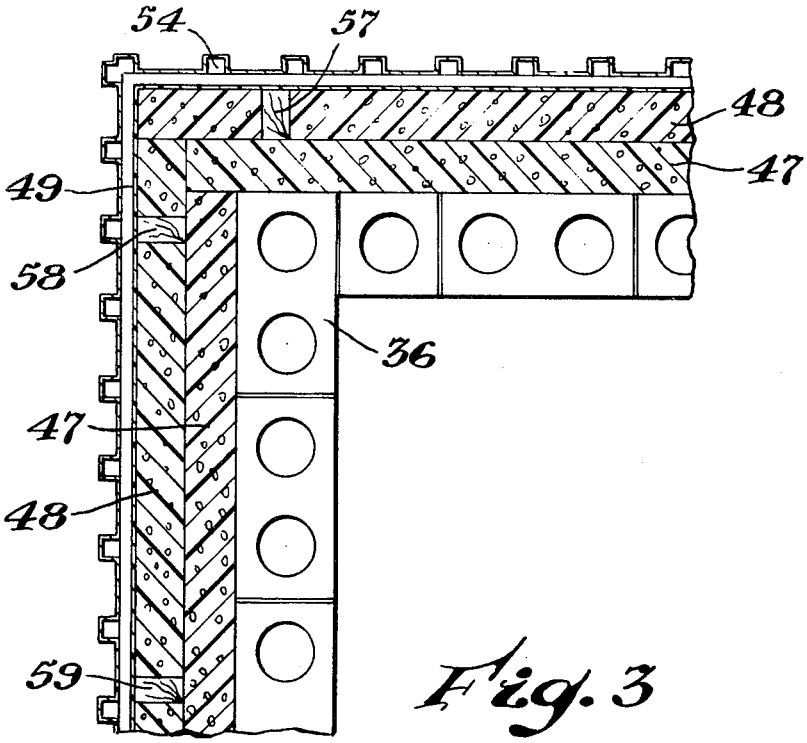
FIG. 3 is a fractional, sectional view of th e building of FIG. 1 taken along the line 3—3 thereof.

FIG. 3 is a schematic sectional representation of a corner of the building 10 taken along the line 3—3 thereof showing the layers of insulation 47 and 48 and vertically extending ledgers 57, 58 and 59. The ledgers 57, 58 and 59 are attached to the horizontal ledgers equivalent to the ledgers 44, 45 and 46 of FIG. 2. Ends of the panels of the layer 47 and the panels forming the layer 48 are butted, and, beneficially if a rigid foam is employed, adhered at the corners.

Figure 4:
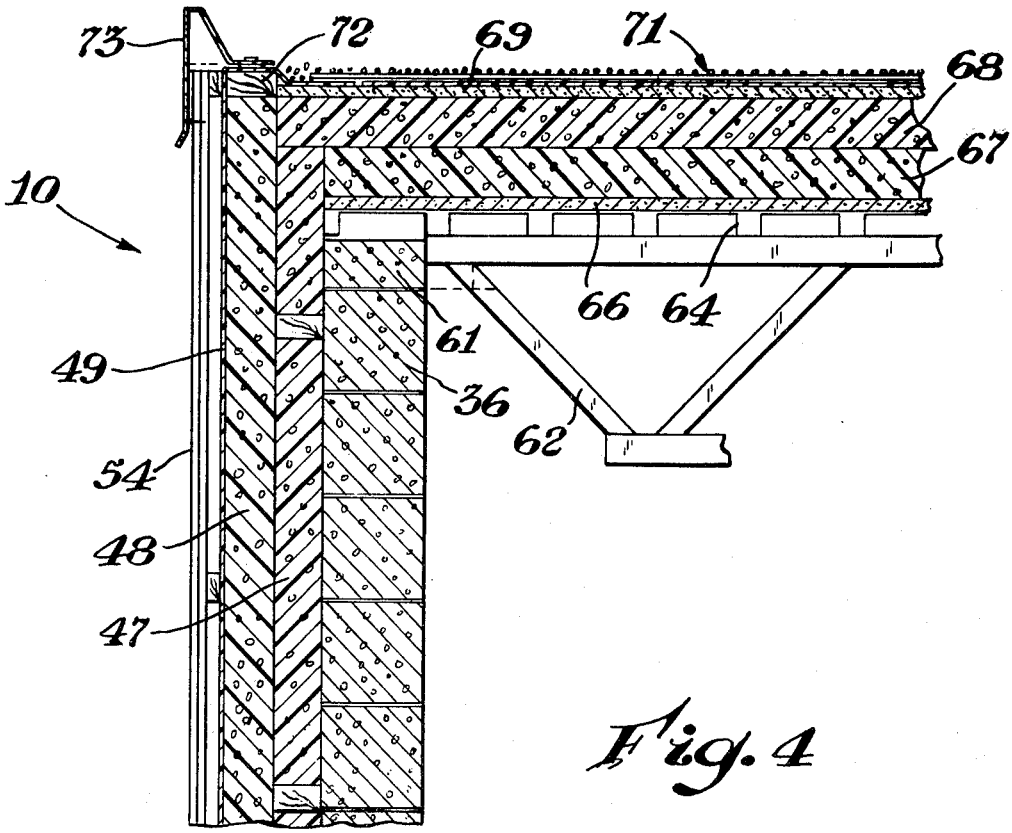
FIG. 4 is a fractional, sectional view of the building of FIG. 1 taken along the line 4—4 thereof.

In FIG. 4 there is depicted a sectional view of the building 10 taken along the line 4—4 of FIG. 1. In FIG. 4 the masonry wall 36 has an upper end 61. A plurality of joists such as joists 62 are supported by the upper end 61 of the wall 36. Joists 62 support a roof deck 64, such as a metal deck as depicted in FIG. 4. Above the metal deck is a rigid non-metal layer 66, beneficially gypsum board etc. fiberboard, plywood, chipboard, or the like. The rigid layer 66 has disposed thereon remote from the roof deck 64 a first insulating layer 67. Beneficially, the layer 67 is of like material to the layer 47. Disposed above the layer 67 and remote from the rigid layer 66 is a second roof insulating layer 68 of similar or dissimilar insulating material to that of the layer 67. The panels forming the layer 67 butt against the panels of the layer 47 and panels of the layer 69 butt against the panels of the layer 48. Adjacent the upper surface of the layer 68 is disposed a rigid layer 69, advantageously of like material to the layer 66. A built-up roof 71 is disposed over the layer 68. Beneficially, the built-up roof comprises a plurality of layers of roofing felt bonded together and to the layer 69 with asphalt, the exposed surface of the roof being covered with gravel. An upper ledger 72 is peripherally-disposed about the rigid layer 69 and is affixed to vertically-extending ledgers such as the ledgers 57, 58 and 59 of FIG. 3. A sheet-metal facia strip 73 is affixed to ledger 72 and to the siding 54.

Figure 5:
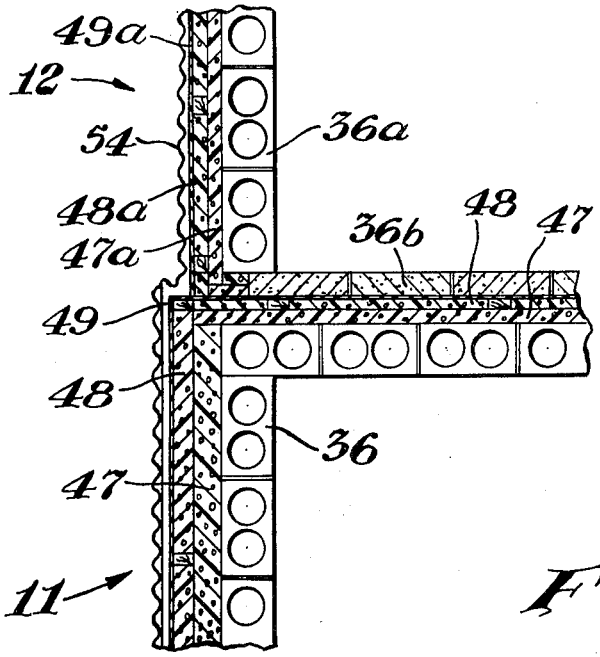
FIG. 5 is a fractional, sectional view of the building of FIG. 1 taken along the line 5—5 thereof.

FIG. 5 is a sectional view of the building 10 along the line 5—5 thereof which shows the juncture of the portions 11 and 12 of the building 10. The portion 12 has a masonry wall portion **36*a* having first and second external layers of insulation 47*a* and 48*a* and an external metal siding 54. The insulating layers 47*a* and 48*a* are of a lesser thickness than the layers 47*b* and 48*b*. An internal masonry wall 36*b* is disposed generally within the portion 12 and is separated from wall 36 of portion 11 by means of the insulating layers 47 and 48 and vapor barrier 49. A vapor barrier 49*a* is disposed on the external surface of insulating layer 48*a***.

Figure 6:
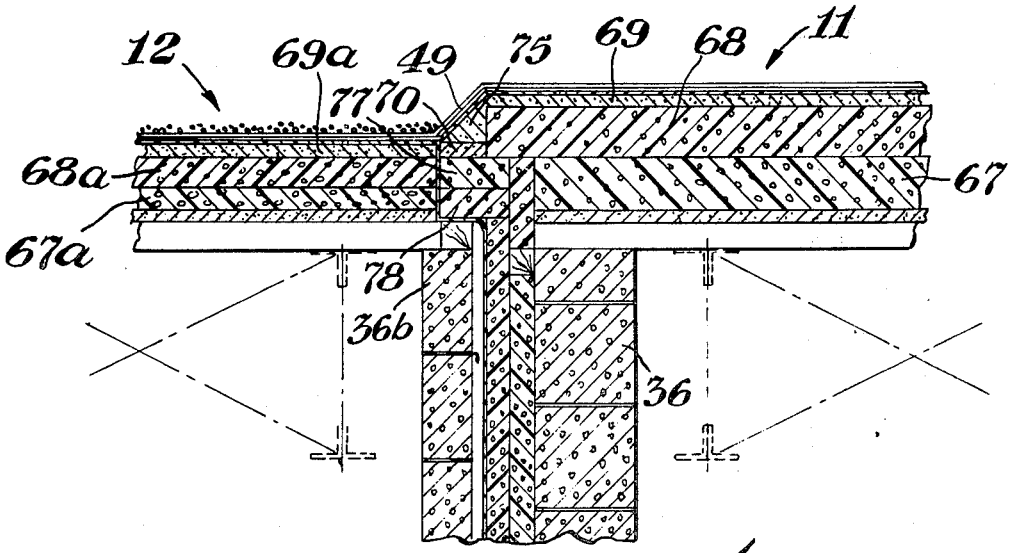
FIG. 6 is a fractional, sectional view of the building of FIG. 1 taken along the line 6—6 thereof.

FIG. 6 is a sectional view of building 10 taken along the ling 6—6 of FIG. 1 and depicts the roof juncture between portions 11 and 12 of the building 10. A cant strip 75 is disposed adjacent the insulating layer 68 in order to provide a transition between roof 69 of portion 11 and roof **69*a* of portion 12. Vapor barrier 49 passes over the cant strip 75 and is sealed to the roof 69 as is the roof portion 69*a*. Filler strips 76, 77 and 78 of insulating foam are disposed between layers 67, 67*a*, 68 and 68*a* which provide mechanical support for the cant strip 75**.

Materials suitable for application as the moisture vapor barrier include polyethylene film, vinylidene chloride polymer film, polyvinyl chloride film, aluminum foil-paper-polyethylene laminate and the like.

A wide variety of insulating materials may be employed for the practice of the present invention. Materials such as foamed styrene polymers, foamed glass, and other thermally insulating foams may be employed. Foamed styrene polymers such as closed-cell foam polysytrene is particularly desirable in that it is rigid and load bearing. Thus, the insulating members such as the members 29 and 31 which are disposed below the floor 38 are made of closed-cell rigid insulating foam such as foamed polystryrene making a crib directly underneath the entire floor 38 unnecessary. Such cribbing would be required if the insulating elements 29 and 31 could not support the weigh of layer 34, the floor 38 and materials resting on the floor 38. Flexible thermal insulating material such as glass fiber bats and the like may be employed for the layers 47 and 48, however, the moisture impermeability of closed-cell rigid plastic foams such as polystyrene provides a substantial advantage in installation as well as their water-barrier characteristics. Similar considerations indicate the desirability of the closed-cell generally water-impermeable foams for the insulating layers 67 and 68 above the roof deck. Such rigid foams are readily affixed in their desired location by means of a mastic, quickly and easily, with a minimum of labor.

Buildings constructed in accordance with the present invention advantageously can employ thermally efficient closed-cell rigid plastic foams positioned with rapid-setting mastic and eliminate the plastering with Portland cement or latex-modified Portland cement commonly used in buildings with conventional insulating techniques are employed and the insulating layer is on the interior of the masonry building.

Insulating in accordance with the present invention reduces thermal cycling of the basic structural elements of the building such as the masonry walls due to seasonal temperature changes thereby reducing the possibility of damage to the thermal insulating layers because of building movement. In the event that the thermal insulation is a combustible material such as a polystyrene foam, polyurethane foam, in buildings in accordance with the present invention, such material is disposed externally to the masonry structure thereby providing a building usually having better acceptance from building code and fire insurance groups. A need for a building sprinkler system has also been eliminated. In the event that there has been mechanical damage to the vapor barrier, the vapor barrier is much more readily inspected and repaired than in conventional internally insulated low-temperature structures. Further, such repairs can be accomplished without shutdown or disruption of activities inside the building. If necessary, additional insulation may be added or repairs to the thermal insulation are readily made with minimal effort.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A method for the preparation of a thermally insulated masonry building, the steps of the method comprising providing a building foundation including a masonry slab, disposing on said slab a vapor barrier, positioning on the vapor barrier a layer of thermally insulating material, constructing masonry walls on the layer of insulating material disposed on the slab, providing a floor member over the insulating material disposed on the slab, providing a roof which covers space enclosed by the walls, disposing on the roof and walls a layer of thermally insulating material, disposing a vapor barrier over the insulating material on the walls and roof and joining the vapor barrier of the walls to the vapor barrier disposed on the slab of the building.

* * * * *